US005752565A

United States Patent [19]

Lemper et al.

[11] Patent Number: 5,752,565

[45] Date of Patent: May 19, 1998

[54] BEAM BLANK STARTER BAR

[75] Inventors: Herbert Lemper, McMurray; Leonard V. Annesi, Bridgeville; Kevin L. Sweeney, Library, all of Pa.

[73] Assignee: Vantage One Design, Inc., Canonsburg, Pa.

[21] Appl. No.: 659,357

[22] Filed: Jun. 6, 1996

[51] Int. Cl.[6] ..... B22D 11/08

[52] U.S. Cl. ..... 164/446; 164/426

[58] Field of Search ..... 164/446, 426, 164/445, 425

[56] References Cited

U.S. PATENT DOCUMENTS

| | | | |
|---|---|---|---|
| 3,262,162 | 7/1966 | Lemper | 22/57.2 |
| 3,442,322 | 5/1969 | Lemper | 154/574 |
| 3,633,653 | 1/1972 | Lyman | 164/445 |
| 5,027,889 | 7/1991 | Thörner et al. | 164/426 |
| 5,135,042 | 8/1992 | Behrends | 164/426 |
| 5,197,533 | 3/1993 | Behrends | 164/446 |
| 5,335,714 | 8/1994 | Arvedi et al. | 164/426 |
| 5,456,307 | 10/1995 | Mouri | 164/426 |

FOREIGN PATENT DOCUMENTS

| | | | |
|---|---|---|---|
| 4119987 | 2/1992 | Germany | 164/446 |

*Primary Examiner*—Joseph J. Hail, III
*Assistant Examiner*—I.-H. Lin
*Attorney, Agent, or Firm*—William L. Krayer

[57] ABSTRACT

A starter bar is designed for beam blank production by continuous casters. The starter bar has a unique transition section including H-profiled segment members which are fixed to an elongated flexible steel band forming the core of the unit. The transition section is readily connected and disconnected to a universal tail section, also having an elongated flexible steel band as its core.

14 Claims, 7 Drawing Sheets

36
17
18
16
17
13
21
37
12
14
15
37
20
8
3
2
4
1b
1b
9
22
1
4
11
5
6
4
7
10

BEAM BLANK STARTER BAR

TECHNICAL FIELD

This invention is in the field of continuous casting of metals, particularly steel. It is a starter bar designed for use in continuous casting of beam blank, or H-shaped, profiles.

BACKGROUND OF THE INVENTION

In the art of continuous casting of steel, a starter bar is used at the beginning of the casting process. The purpose of the starter bar is to provide an initial base or support, known as a head, for the liquid metal to be poured continuously into the cooling mold. The head is attached to other elements which are designed to follow the intended downward course of the incipient continuous cast strand from the mold through at least a portion of the curved caster. Because of the curvature of the caster, starter bars should be flexible, and in the past many designs for starter bars have employed various linkages necessarily having spaces, gaps, or tolerances between them which, added together, and particularly after some wear, can lead to a sudden movement of the head when the weight of the cast strand causes a compression of the linkages previously pulled apart by the action of the caster's drive rolls.

The three basic portions of a starter bar are the head, the universal portion, and an intermediate transition portion. Typically, the universal portion of a starter bar is designed to be useful without modification for various sizes and shapes of the strands to be made in continuous casting machines. The head portion is unique to the particular profile of the mold, and the intermediate portion, the transition section, is also designed for the particular shape of the cast strand after emerging from the mold. After the universal portion, transition section, starter bar head, and the beginning of the newly cast strand have passed the last pair of driving rolls, the head can be disconnected from the cast strand and the casting process continued without the starter bar.

Examples of prior art starter bars may be seen in Lemper's U.S. Pat. Nos. 3,262,162, 3,442,322, and 4,660,616, and in Behrends'U.S. Pat. Nos. 5,135,042 and 5,197,533.

A very difficult strand profile or cross section for the design of a starter bar is the beam blank, or H-shaped profile, which will be sometimes called a beam blank herein. The initial problem is that the head must be H-shaped to fit into the beam blank mold and the transition section must simulate the H-shaped cast strand while moving through the caster's containment sections. The unique shape of the transition portion of the starter bar must be initially supported in the containment section of the caster, and, while simulating the contact points of the cast strand, the entire starter bar must present a smooth rolling surface to the driving rolls to avoid any irregular withdrawal movements or stoppages when the starter bar is either curved or straight. The entire starter bar must be bendable in only one direction, and rigid in the opposite direction, in order to support its own weight while passing over supporting rolls with large center distances. And, transition links must be designed to accommodate different sizes of heads as well as the universal portion of the starter bar which can be of more or less standard design.

SUMMARY OF THE INVENTION

Our invention calls for the formation of a starter bar from two flexible steel bands in tandem which together extend almost the full length of the starter bar. One flexible steel band forms the core of the universal portion of the starter bar and the other flexible steel band forms the core of the transition portion of the starter bar. A third portion of the starter bar is the H-shaped head, but as the head may be readily detached from the transition portion, our invention is concerned mainly with the balance of the starter bar, and in one aspect of the invention is limited to the transition portion.

The transition portion has a series of top and bottom plates fixed to the flexible steel band by shouldered bolts so that no projections are seen or felt by supports or rolls used to move the starter bar. The ends of the top plates and bottom plates are separated from each other by small spaces approximately the width needed to permit the flexible steel band to flex within the curve of the caster. The top plates are also separated from the flexible steel band by a small dimension which also permits flexing of the flexible steel band. The area covered by each of the top or bottom plates is herein called a segment. The segment is further defined by side plates attached to the bottom plates to form a unit having an H shape; the bottom plate, in the plane parallel to the flexible steel band, is hereafter called the H-web.

The universal portion of the starter bar may also, optionally, be equipped with top and/or bottom steel plates, but preferably has smaller top plates only, as will be illustrated below.

The transition portion and the universal portion are fastened together through the use of a master linkage between the two portions of flexible steel plate. The same type of bolt fasteners as used in the transition and universal sections is used in the master linkage, which is designed to permit the same degree of "flexing" between the two ends of the flexible steel bands as the transition and universal segments permit with an undivided segment of the flexible steel band.

As explained above, each segment of the transition portion has side plates welded or otherwise affixed to the H-web, which is fastened to the bottom, or underside, of the flexible steel band. The side plates are sized so that pinch rolls and other mechanisms for moving the strand can work on both the starter bar transition portion and the strand itself without significant adjustment. As will be seen in the drawings and discussions below, the side plates may overlap each other.

DETAILED DESCRIPTION OF THE INVENTION

The invention will be further explained with reference to the accompanying drawings.

Figures 1A, 1B:
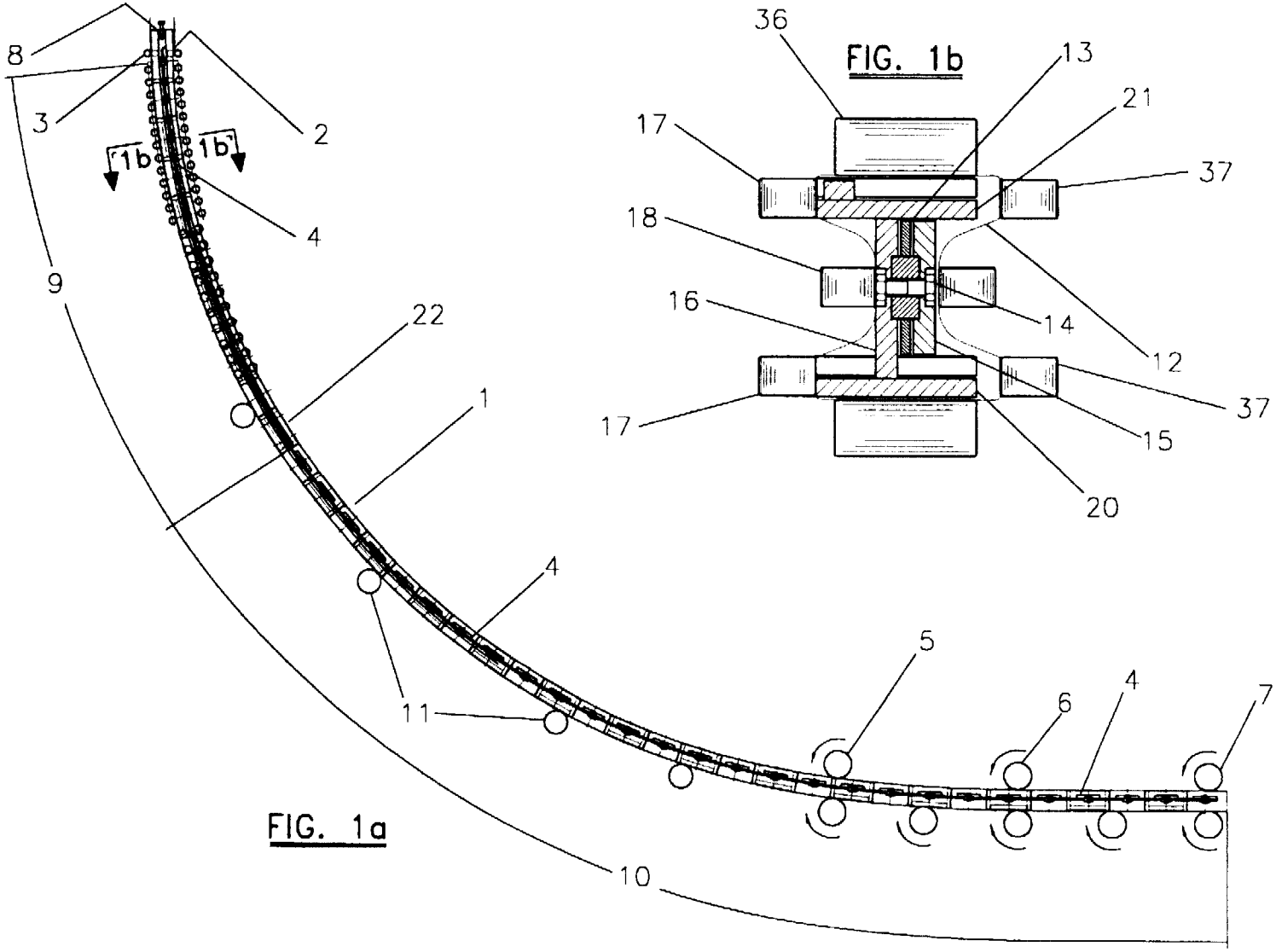
FIG. 1*a* shows the curved guide frame of a conventional continuous beam blank caster, starting with the bottom of the mold and continuing to the horizontal portion.
FIG. 1*b* is a more or less diagrammatic imposition of a beam blank product profile on a profile of a transition segment of the present invention, showing the placement of support and containment rollers.

Referring to FIG. 1*a*, the continuous guide frame 1 is seen to begin at the bottom of mold 2, where the first rolls applied are the mold foot rolls 3. The starter bar 4 is laid on and extends throughout the length of the guide frame 1, generally to the driving pinch rolls 5, 6, and 7. The head portion 8 of the starter bar 4 is inserted into the mold 2, and is connected immediately to the transition section 9, which in turn is connected through master segment 22 to the universal section 10 of starter bar 4. Various other support rolls 11 are seen to be spaced along the caster 1.

An outline of the H profile of a cast strand 12 is seen, in FIG. 1*b*, to be imposed on a section of the transition portion of the starter bar taken at z–z in FIG. 1*a*. In the center is flexible steel band 13 traversed by bolt 14 shouldered so as not to protrude beyond the surface of top plate 15 and H-web 16. This Figure illustrates how the profile of the starter bar transition section 9 is adapted to be similar to the profile of the incipient cast strand 12 so that lower flange roller supports 17 and web roller supports 18 will contact it firmly. The cast strand 12 is also contained by side containment rolls 36. Side plates 20 and 21 are welded or otherwise permanently fixed to the H-web 16. Upper flange roller supports 37 are shown contacting the cast strand 12 but it is not necessary that they contact side plates 20 and 21.

Figure 2A:
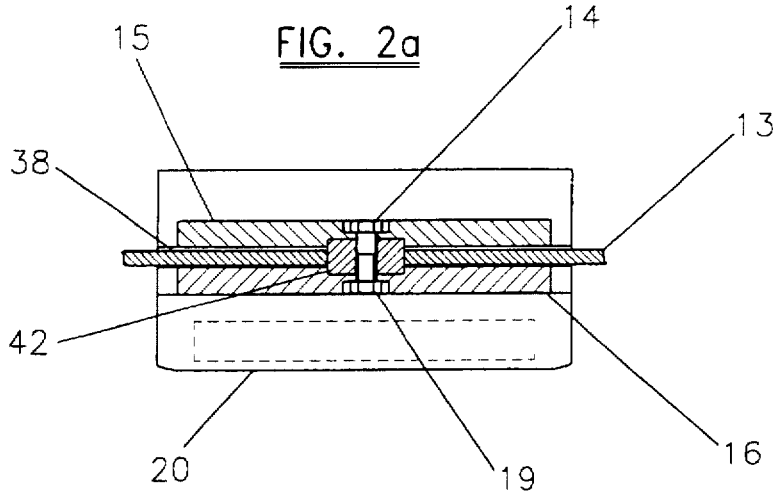
FIG. 2*a* is a side sectional view of a transition segment.

FIG. 2*a* is a side section of a transition segment in its normal or horizontal configuration, showing the central flexible steel band 13, bolt 14 and nut 19, and H-web 16. There is a space 38 between top plate 15 and flexible steel band 13, which permits some upward flexing of steel band 13. The appropriate space 38 is assured by spacer 42. Spacer 42 also serves as a force transmitting key, assuring full application to flexible steel band 13 of the driving forces of pinch rolls 5, 6, and 7 through side plates 20 and 21 (FIGS. 1*a* and 1*b*). Side plates 20 and 21 are shown to be attached to the H-web 16 (FIG. 1*b*).

Figure 2B:
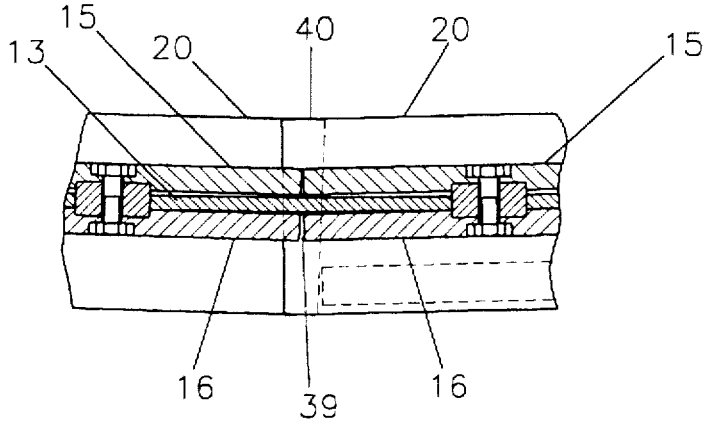
FIG. 2*b* is a side sectional view of two adjacent transition segments in which the flexible steel band has been flexed.

In FIG. 2*b*, the flexible steel band 13 contained within two adjacent transition segments similar to that of FIG. 2*a* has been flexed upwardly, creating a space 39 between the H-webs 16. Side plates 20 form an overlapping surface 40 for roll contact.

Figure 2C:
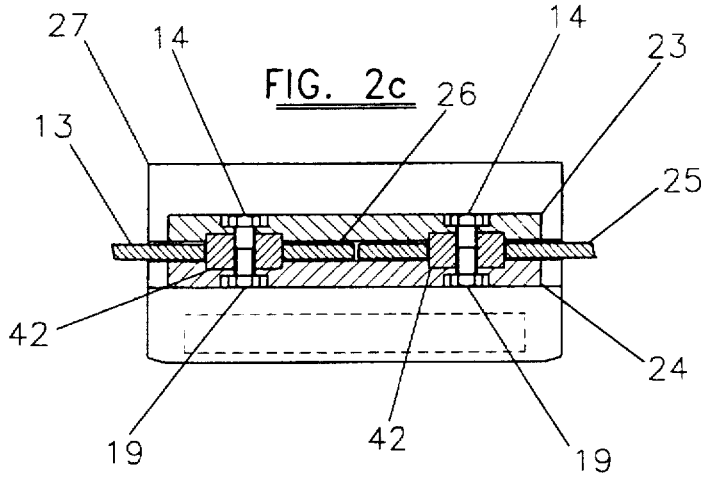
FIG. 2*c* is a side sectional view of a master segment for connecting the flexible steel bands of the universal portion and the transition portion.

In FIG. 2*c*, a master segment is shown comprising a master segment top plate 23 and a master segment H-web 24, fastened together by two bolts 14 positioned similarly to those discussed previously, i.e. so they will not protrude above the surface of the top and bottom master segment top plate 23 and master segment H-web 24. In this view, the flexible steel band 13 of the transition section is connected to a similar flexible steel band of the universal section, which may be called the universal flexible steel band 25. Master segment top plate 23 and master segment H-web 24 both span the ends of flexible steel bands 13 and 25. Again, a space 26 above both flexible steel bands 13 and 25 and below master segment top plate 23 is assured by spacers 42 to permit flexing and the two flexible steel bands do not contact each other so they will be free to move at the slight angle necessitated by flexing. Side plates 27 are welded or otherwise fixed to master segment H-web 24.

Figure 3A:
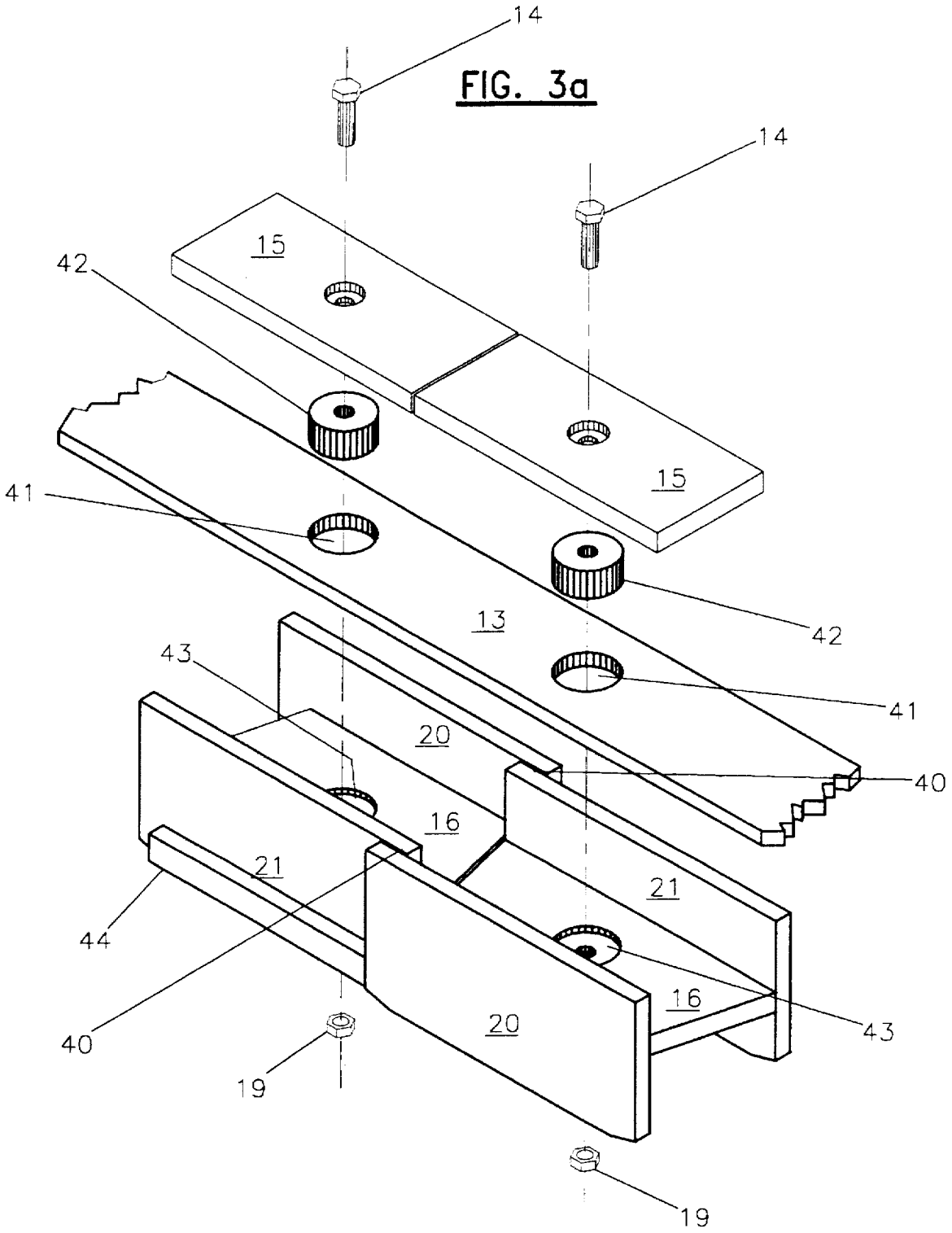
FIGS. 3*a*, 3*b*, and 3*c* show exploded views of two segments of the transition portion, two segments of the universal portion of our starter bar, and a connecting segment.

In FIG. 3*a*, two segments of the transition portion of our invention are shown. Flexible steel band 13 forms the unitary core of the transition portion. It has centrally located holes 41 to accommodate spacers 42 which will rest on recesses 43 in H-webs 16, insuring the requisite space 38 (see FIG. 2*a*) will be maintained between flexible steel band 13 and top plates 15. Side plates 20 and 21 are welded to H-webs 16, and may overlap to form surface 40 as seen also in FIG. 2*b*, to provide smooth roller contact from segment to segment. The segments may also have sidebars 44 which butt against side plates 20 to inhibit negative flexing, and to maintain good continuity with other containment means such as containment rolls 36 seen in FIG. 1*b*. The H-webs 16 may have trapezoidal shapes as shown in FIG. 3*a* or other angular ends, also to provide smooth contact with the containment means such as web roller supports 18 seen in FIG. 1*b*. Bolts 14 and nuts 19 connect as also shown in FIG. 2*a*.

Figure 3B:
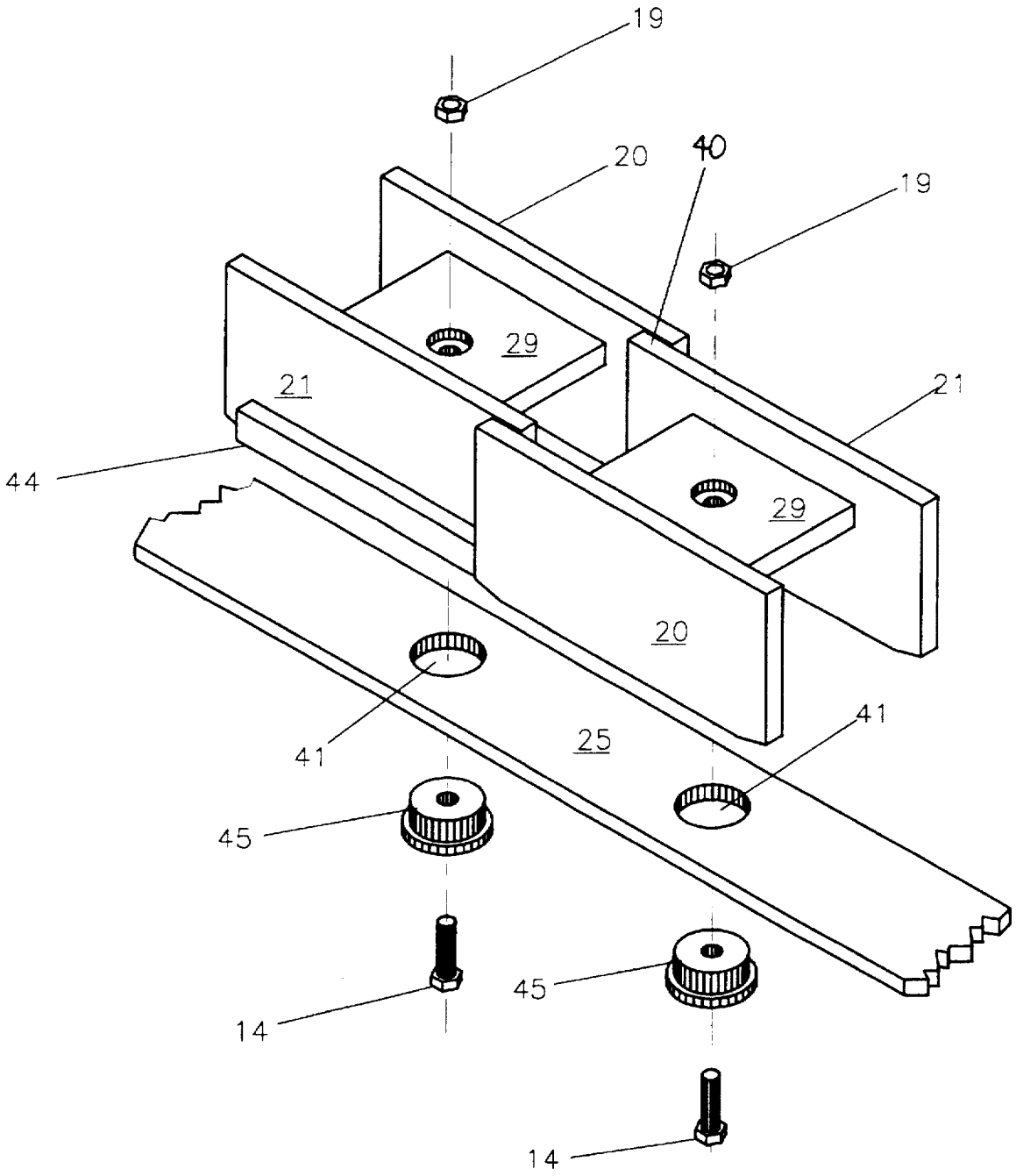

The universal portion may be constructed somewhat differently, as may be seen in FIG. 3*b*. In FIG. 3*b*, universal H-webs 29 are designed for placement on the upper side of flexible steel band 25, held a slight distance thereabove by collared spacers 45, there being in this variation no plate underneath the flexible steel band 25. Collared spacers 45 preferably snugly fit in holes 41, perform a function similar to spacers 42 in the transition section, namely they assure transfer of the driving force from the side plates 20 and 21 through universal H-webs 29 to flexible steel band 25. It is not necessary for universal H-webs 29 to have angled ends because they need not extend the whole length of the segments. The segments further comprise sidebars 44. Overlapping sides 20 and 21 form a surface 40 as in FIG. 3*a*.

Figure 3C:
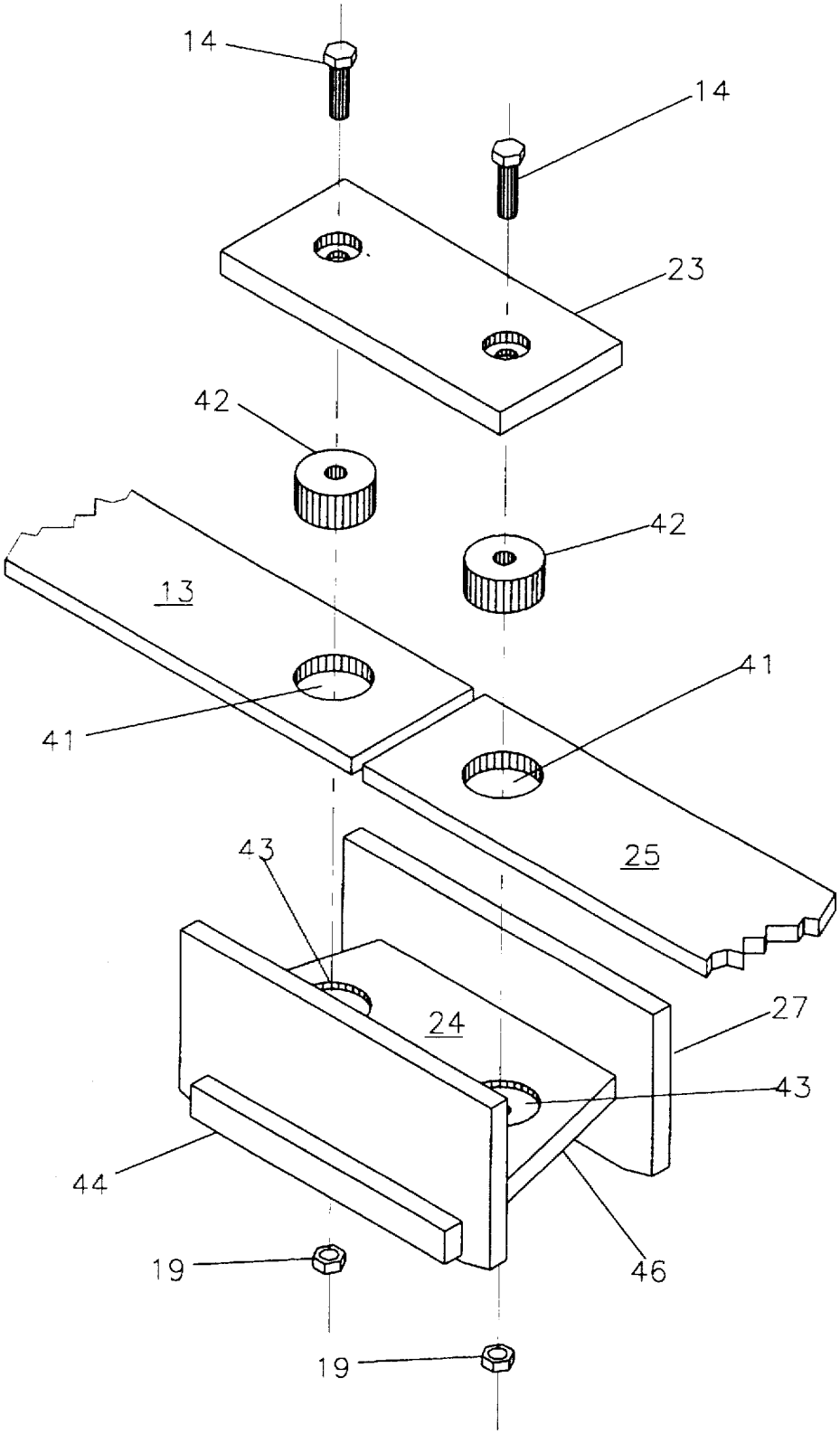

The master segment depicted in FIG. 3*c* further illustrates that of FIG. 2*c*; its position in the starter bar is seen as master segment 22 in FIG. 1*a*. Spacers 42 rest on recesses 43 of master segment H-web 24, assuring the desired space between flexible steel bands 13 and 25 and master segment top plate 23. Master segment H-web 24 has two recesses 43, and the flexible steel bands 13 and 25 are each provided with a hole 41 for a bolt 14, nut 19 and spacer 42. The segment may have a sidebar 44 and angled ends 46.

Figure 4:
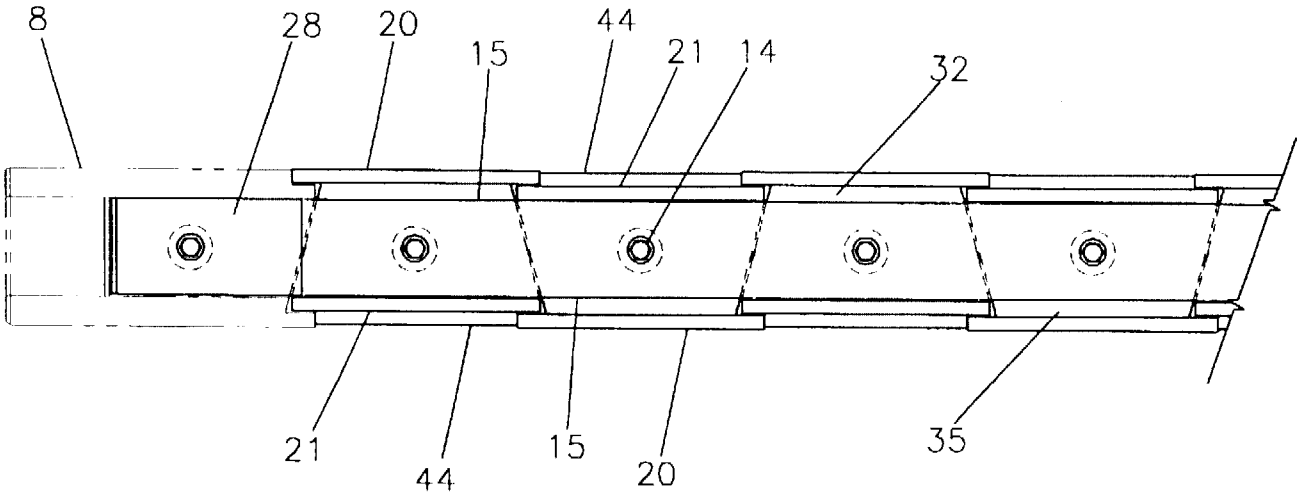
FIG. 4 is an overhead view of several segments of the transition portion together with the head.

In FIG. 4, head 8 and several transition segments are shown. The head 8 is shown in phantom as a dotted line because it is designed for a specific mold, usually by the user. Our preferred transition section has a neck 28 which is a short extension of flexible steel band 13, which is hidden by top plates 15. Neck 28 is ready to receive and be attached to head 8. The transition section is a single unit comprising a series of segments tied together by the flexible steel band 13. Side plates 20 and 21 alternate in position on each side of the transition portion, thus forming gaps 32 and 35 between top plates 15 and side plates 20 and 21. Side bars 44 may also be seen.

Figure 5:
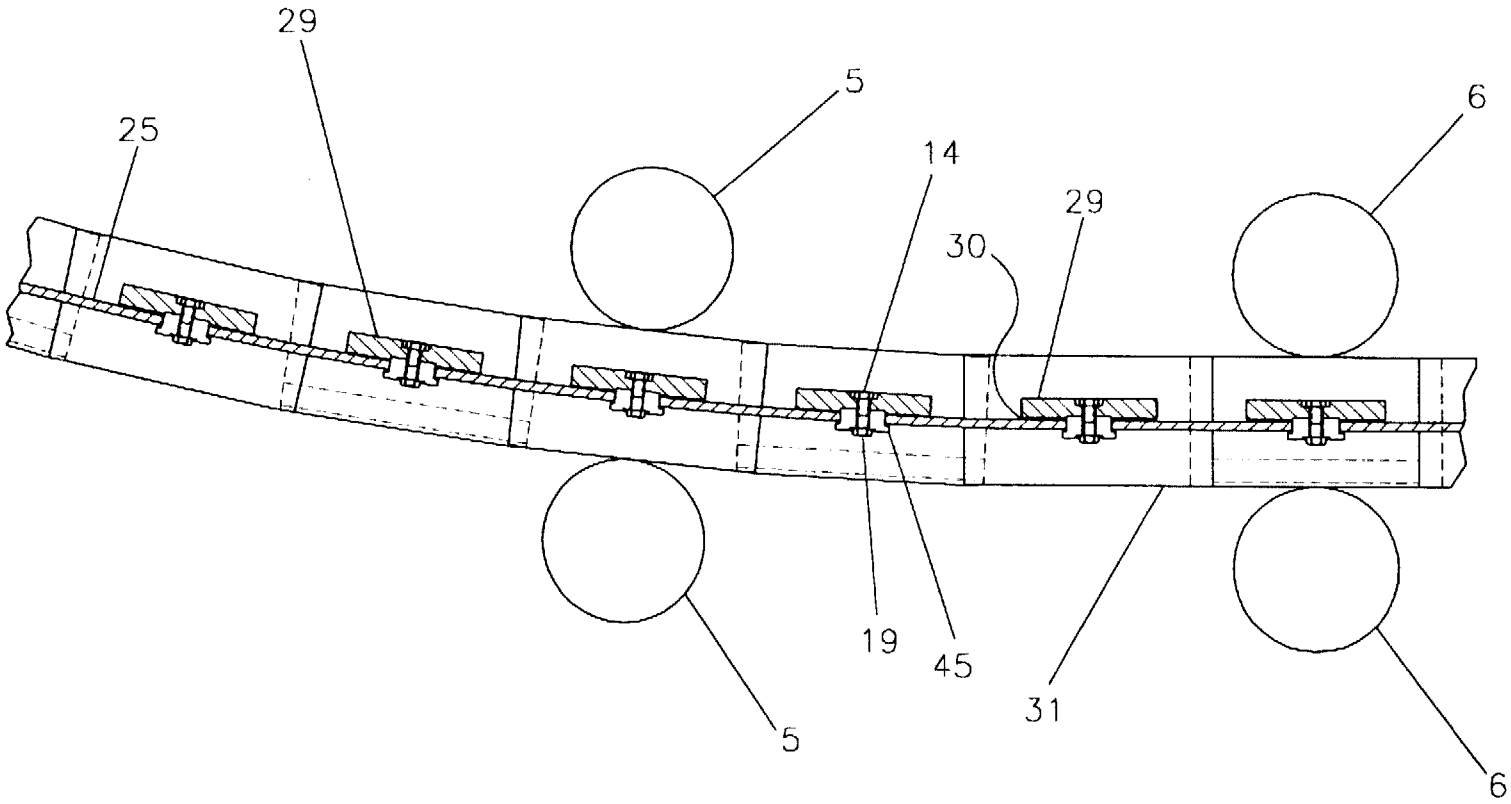
FIG. 5 is a side view of several segments of the universal portion of the starter bar.

FIG. 5 depicts several segments of the universal section of our starter bar. It will be seen that a plurality of universal H-webs 29 are fastened to flexible steel band 25 in a manner similar to that described above, i.e. using bolts 14 and providing a space 30 between the universal H-webs 29 and the flexible steel band 25. FIG. 5 includes, more or less diagrammatically, sets of pinch rolls 5 and 6 which provide contact points for working on the side plates 31. As seen in FIG. 4, the side plates 31 may overlap, and of course the pinch rolls 5 and 6 are wide enough to contact both the outer and inner side plates 31 as the starter bar is flexed. Thus the universal section of our starter bar may handle any type of profile of the cast strand 12.

Our invention may therefore be seen to be a starter bar for a beam blank, comprising a transition section and a universal section connected in a continuous unit without loose linkages, yet it is able to flex readily. The transition section is novel by itself, and may be connected through our master segment to any conventional universal section as well as to our own as described herein. Thus the universal section need not be constructed as shown herein with a flexible steel band core, but may be of any conventional design suitable for a beam blank starter bar, so long as it can be connected to our transition section. By this we mean to include universal sections which are not based on a unitary flexible steel band; they may comprise segments having linkages such as transverse pins and the like, or even chain-like linkages.

The transition section comprises preferably a unitary elongated flexible core and a plurality of H-profiled segment members each attached loosely by its web to the elongated flexible core along its length. By attached loosely, we mean to provide space enough above the flexible steel band to permit its flexing to follow the curvature of the caster. The segment members are arranged end-to-end with space enough between them to prevent binding, and the sides of the H-profiled segment members may overlap; the sides of the H-profiled segment members are of dimensions to simulate the sides of the incipient beam blank on emerging from the caster mold, to provide a smooth transition for the support rolls of the caster.

The universal portion of the starter bar is also provided with H-profile segments for the same reason, so the pinch rolls will provide a driving force for the operation of the machine, drawing the entire starter bar including the head, and the beginning of the cast strand through the mold and the rest of the course of the caster. Persons skilled in the art will realize that the master segment 22 connecting the transition section and the universal section is designed also to preserve the simulation of the beam blank and that, in fact, the entire starter bar effectively simulates the beam blank while leading it through guide frame 1.

While our illustrated preferred embodiment has a single elongated flexible steel band as the core of the transition section, we do not mean to exclude the possibility that two or three shorter flexible steel bands could be connected in tandem in a manner similar to that illustrated in FIG. 3*c* or some other similar manner. The term "flexible steel band" as used herein is meant to include such variants having equivalent function.

We claim:

1. A beam blank starter bar for a continuous caster comprising (a) a transition section comprising a first flexible steel band core and a plurality of H-profiled segment members attached to said first flexible steel band core to permit flexing of said first flexible steel band core and simulating the profile of a continuous cast beam blank strand in said continuous caster, and (b) a universal section comprising a second flexible steel band core and means attached thereto adapted to permit driving of said starter bar by pinch rolls on said caster.

2. A beam blank starter bar of claim 1 including means for attaching a head section adapted to fit a beam blank mold.

3. A beam blank starter bar of claim 1 wherein said H-profiled segment members are attached to said first flexible steel band core on the bottom thereof.

4. A beam blank starter bar of claim 1 including a connector between said transition section and said universal section comprising an H-profiled segment member and a plate, said H-profiled segment member and said plate both spanning the ends of said first and second flexible steel bands on opposite sides and loosely attached to both of said first and second flexible steel bands.

5. A beam blank starter bar of claim 3 wherein said H-profiled segment members are attached to the bottom of said first flexible steel band core.

6. A beam blank starter bar of claim 3 wherein said H-profiled segment members simulate a cast beam blank strand.

7. A transition section of a beam blank starter bar comprising a flexible steel band and a plurality of H-profiled segment members attached to said flexible steel band to permit flexing of said flexible steel band and simulating the profile of a continuous cast beam blank strand in a continuous caster.

8. A transition section of claim 7 wherein said H-profiled segment members are attached to said flexible steel band on the bottom thereof.

9. A transition section of claim 7 wherein said H-profiled segment members are attached loosely to said flexible steel band on the bottom thereof and a plurality of plates are attached on the top thereof.

10. A connecting segment for a beam blank starter bar for a continuous caster having contact points for driving and guiding a cast beam blank strand, comprising (a) an H-profiled segment member having an H-web of a length and width to receive and span the ends of two flexible steel bands and having sides of a height to simulate a beam blank at said caster contact points, (b) a rigid plate of a length and width to fit between said sides of said H-profiled segment member and span the ends of two flexible steel bands, and (c) means for loosely attaching said H-profiled segment member and said rigid plate through said flexible steel bands.

11. A beam blank starter bar for a continuous caster, said continuous caster having containment means and pinch rolls and employing a beam blank mold, said starter bar comprising (a) a transition section comprising a first elongated flexible band, and a plurality of H-profiled segments, said H-profiled segments having H-webs, said H-profiled segments loosely attached by the H-webs thereof to said first elongated flexible band along the length thereof so as to permit flexing of said first flexible steel band in said caster, said H-profiled segments having side plates adapted to contact said containment means, and (b) a universal section comprising a second elongated flexible band and means on both sides of said second elongated flexible band for contacting said pinch rolls.

12. A beam blank starter bar of claim 11 including a connector for said transition section and said universal section, said connector comprising a top plate and a bottom plate, each of said top plate and bottom plate spanning an end of said first and said second elongated flexible bands, and means for loosely attaching said top and bottom plates to both of said first and second elongated flexible bands, said bottom plate being an H-web and having perpendicular sides of a height to simulate a beam blank.

13. A beam blank starter bar of claim 11 having steel plates attached to the side of said first flexible steel band opposite the side on which said H-profiled segments are attached.

14. A beam blank starter bar of claim 13 wherein each of said steel plates and said H-profiled segments is attached to said first elongated flexible band at a single point.

* * * * *